United States Patent [19]

Shaffer

[11] 4,212,233

[45] Jul. 15, 1980

[54] BLOWER UNIT FOR WALL HEATER HAVING SLOTTED FRONT PANEL

[76] Inventor: Robert H. Shaffer, 492 Sierra Vista Ave., Mountain View, Calif. 94043

[21] Appl. No.: 867,638

[22] Filed: Jan. 6, 1978

[51] Int. Cl.[2] ..... G03C 1/28

[52] U.S. Cl. ..... 98/108; 98/39; 165/39

[58] Field of Search ..... 165/55, 122, 22, 39; 98/39, 108; 236/38; 417/14

[56] References Cited

U.S. PATENT DOCUMENTS

| | | | |
|---|---|---|---|
| 2,151,725 | 3/1939 | Woolley | 98/39 |
| 3,217,627 | 11/1965 | Sweeney | 98/108 |
| 3,355,030 | 11/1967 | Catacart | 211/117 |
| 3,985,295 | 10/1976 | Monninger | 165/122 |

FOREIGN PATENT DOCUMENTS

| | | | |
|---|---|---|---|
| 1375169 | 10/1969 | United Kingdom | 98/39 |
| 1166341 | 11/1974 | United Kingdom | 98/39 |

*Primary Examiner*—Samuel Scott
*Assistant Examiner*—G. Anderson
*Attorney, Agent, or Firm*—John L. McGannon

[57] ABSTRACT

A blower unit for releasable attachment to the slotted front panel of a wall heater. The blower unit includes a blower having an inlet, an outlet, and a motor-driven rotor for generating an air flow between the inlet and the outlet. A housing is attached to the blower and has a first opening aligned and communicating with the blower outlet thereof for receiving an air flow therefrom. The housing has a second opening spaced from the first opening, and a pair of spaced projections are carried by the housing and insertable in a slot of the front panel of the wall heater for mounting the housing and thereby the blower in an operative position on the front panel externally thereof with the second opening adjacent to and aligned with at least one slot so that, when the blower is energized, air will flow into and through the housing and out of the second opening into the wall heater through the one slot to cause heated air in the heater to be forced out of the other slots of the front panel. A thermostatic limit switch carried by the housing senses the temperature of the air flowing out of the wall heater to control the operation of the blower.

11 Claims, 5 Drawing Figures

BLOWER UNIT FOR WALL HEATER HAVING SLOTTED FRONT PANEL

Figure 1:
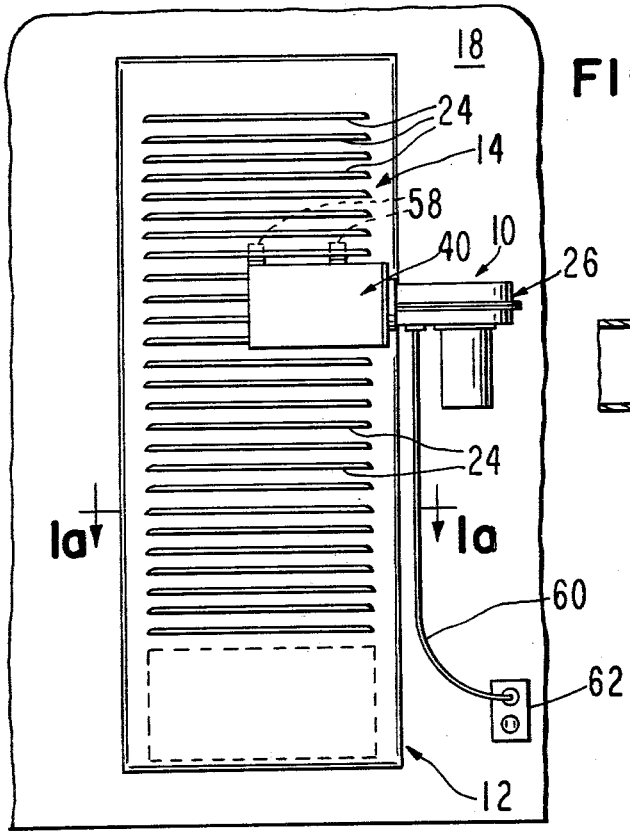

This invention relates to improvements in wall heaters and, more particularly, to a blower unit for external attachment to a wall heater to increase the volume rate of flow of hot air out of the heater and into the adjacent room or space to be heated.

BACKGROUND OF THE INVENTION

Conventional wall heaters typically are of the type in which a burner assembly is into a recess or space in a wall to heat the air in the space. The front boundary of this is covered by a front panel, usually of metal, provided with a number of spaced, generally horizontal slots. The heated air in the space rises by convection and eventually flows out of the space through the slots and into the adjacent room.

A major disadvantage of the wall heater of this type is that considerable time is required to heat the room because of the relatively slow movement of heated air by convection out of the space occupied by the wall heater. Thus, a considerable amount of time and a considerable amount of fuel, such as natural gas or oil, are expended to heat the room because the volume rate of flow of air out of the wall heater space through the slots of the front panel is relatively low.

Wall heaters of this type have generally been described in the following U.S. Patents:

| | |
|---|---|
| 1,645,140 | 2,834.279 |
| 1,875,683 | 3,295,749 |
| 2,528,650 | 3,358,675 |
| 2,679,202 | 3,384,070 |
| 2,733,704 | 3,394,696 |

None of the foregoing shows or suggests a simple way of increasing the volume rate of flow of heated air from a wall heater of the type described without incorporating a blower within the wall heater space. Specifically, none of the patents shows a device which can be quickly and easily mounted externally on a wall heater to accomplish this purpose. For this reason, and in view of fuel shortages now experienced in many places throughout the world, a need has arisen for an improved apparatus for use externally of a wall heater and one which is capable of increasing the volume rate of flow of heated air from a wall heater to heat up a room adjacent to the wall heater more quickly while at the same time conserving fuel and thereby minimizing the energy required to accomplish this purpose.

SUMMARY OF THE INVENTION

The present invention is directed to satisfying the aforesaid need by providing an improved means for attachment externally to a wall heater to blow air into the wall heater space to increase the volume rate of flow of heated air out of such space. Thus, considerable energy savings can be realized yet the heating of a room adjacent to the wall heater can be accelerated.

To this end, the present invention includes a blower unit having a blower in combination with a hollow housing provided with structure for releasably coupling the unit to the slotted front panel of a wall heater externally thereof. The blower itself has an inlet, an outlet, and a motor-driven rotor therewithin for generating a flow of air between the inlet and outlet. The housing is coupled to the blower and receives an airflow therefrom, the housing having an opening which is adjacent to and aligned with at least one slot of the front panel of the wall heater when the blower unit is coupled thereto. Air is thereby forced through the housing and through a slot into the interior of the wall heater so that the air forced into the wall heater space will force hot air in such space out of the same which would otherwise occur only by convection. Thus, the volume rate of flow of air is increased from the heater and the room or space adjacent to a heater is more quickly and more uniformly heated.

The present invention also includes a thermostatic limit switch coupled to the blower for turning the same on and off as a function of the temperature of the air leaving the wall heater through the slots of the side panel thereof. Thus, this assures a significant saving in fuel for operating the wall heater since the burner of the wall heater is thermostatically controlled and will be shut-off when the temperature in the room rises to a certain value. Also the blower of the present invention will shut off when the air temperature leaving the wall heater reaches a certain value to assure a balance of temperature uniformly throughout the room.

The primary object of this invention is to provide an improved blower unit for mounting externally of a wall heater to cause air to be forced into the wall heater space to increase the volume rate of hot air flowing from such space to more readily and more uniformly heat the room adjacent to the wall heater with a considerable saving of fuel.

Another object of this invention is to provide an improved blower unit of the type described wherein the unit includes a housing provided with an opening positionable adjacent to the front panel of the wall heater to force air into one or more slots of the panel and thereby force hot air out of the same at a greater rate than would ordinarily occur so that heating time is minimized and fuel is conserved.

Other objects of this invention will become apparent as the following specification progresses, reference being had to the accompanying drawing for an illustration.

Figure 1A:
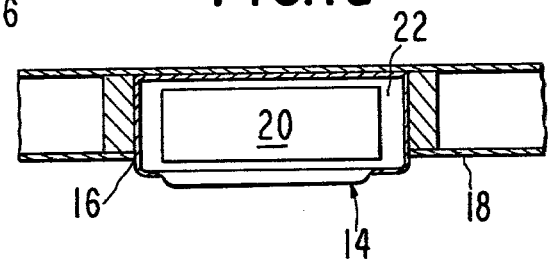
Figure 1B:
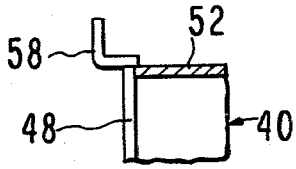

IN THE DRAWING:

FIG. 1 is a side elevational view of a wall heater having a slotted front panel and showing the blower unit of the present invention coupled to the panel to force air through the slots and into the wall heater space;

FIG. 1*a* is a cross-sectional view taken along line 1*a*—1*a* of FIG. 1.

Figure 2:
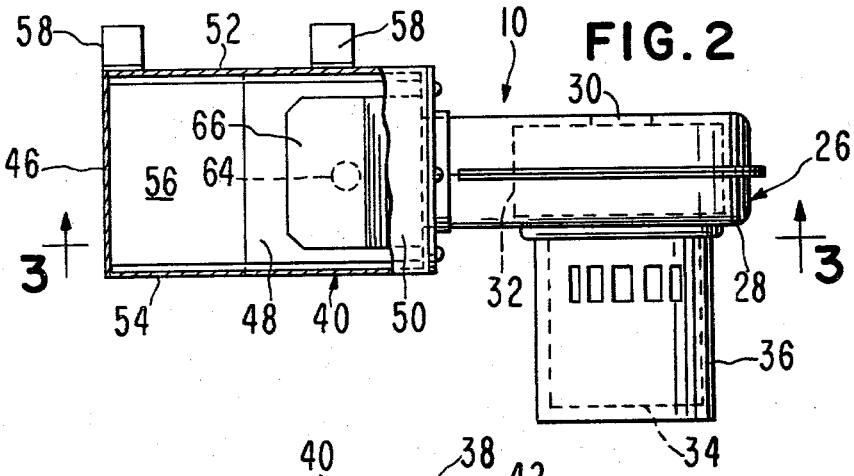
Figure 3:
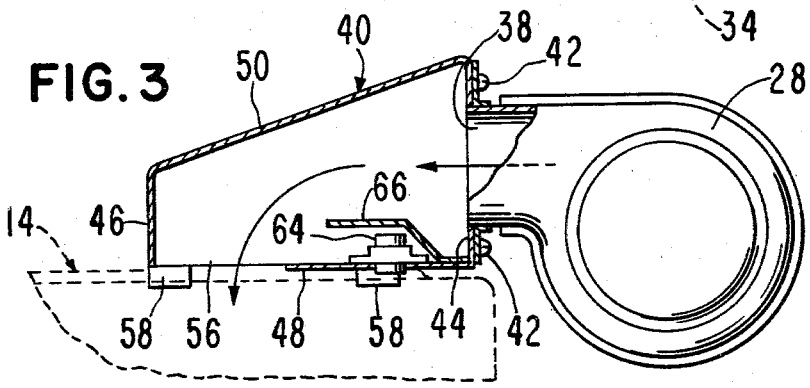

FIG. 2 is an enlarged side elevational view of the blower unit with the housing thereof broken away to illustrate details of construction;

FIG. 2*a* is an enlarged, fragmentary, cross-sectional view of one of the projections for mounting the unit on the front panel of a wall heater; and FIG. 3 is a cross-sectional view taken along line 3—3 of FIG. 2.

The blower unit of the present invention is broadly denoted by the numeral 10 and is adapted to be used with a wall heater 12 of the type having a slotted front panel 14 covering a front opening 16 formed in a wall 18 and provided with a burner assembly 20 which heats air in the wall heater space 22 covered by panel 14 so that the air heated by the operation of burner assembly 20 rises by convection and passes out of space 22 through spaced slots 24 in panel 14. The heated air thus heats the room or space adjacent to wall 18. Slots 24 can be arranged in any desired pattern in side panel 14. For purposes of illustration, the slots are arranged horizontally throughout a major portion of the height of the panel.

Blower unit 10 comprises a standard blower 26 having a generally circular housing 28 provided with an air inlet 30 and a rotor 32 rotatable about a central axis by a drive motor 34 within a casing 36 secured to housing 26. When the motor is energized, air entering inlet 30 is directed through housing 26 and out of the same through outlet 38 (FIG. 3) thereof.

The air leaving blower housing 28 is directed into a hollow housing 40 secured in any suitable manner, such as by screw fasteners 42, to housing 28 at the outlet 38 thereof. Housing 40 has a pair of spaced sidewalls 44 and 46, a front wall 48, a rear wall 50 and top and bottom walls 52 and 54. Wall 44 has an opening aligned with outlet 38, and front wall 48 has an opening 56 near sidewall 46. Thus, air entering housing 40 from blower 26 is forced out of housing 40 through opening 56. Backwall 50 is angled relative to front wall to urge air flowing through housing 40 toward outlet opening 56. Housing 40 can have other wall shapes, if desired, except that front wall 48 should be substantially flat because it is to be placed face-to-face relationship with panel 14 when unit 10 is mounted on panel 14 as hereinafter described.

A pair of spaced L-shaped projections 58 are secured to housing 40 and project forwardly from front wall 48 in the manner shown in FIG. 2*a*. Projections 58 are adapted to be inserted into a slot of panel 14 to hook behind the panel and to hold unit 10 thereto as the lower margin of housing 40 merely engages panel 14. The projections can readily be inserted into a slot when unit 10 is held in the hand and as front wall 48 faces downwardly. Then, after projections 58 are in the slot, the unit is allowed to pivot downwardly until the lower margin of front wall 48 engages panel 14. Blower unit 10 is then prevented from falling downwardly since the center of gravity of unit 10 is spaced outwardly from the panel and tends to pull projections 58 straight outwardly from the slot. However, the vertical part of each projection 58 prevents this from happening; thus, the unit is releasably held to the panel.

Electrical power to motor 34 is supplied by an electrical conductor 60 having a plug coupled to a standard wall receptacle 62. A thermostatically controlled limit switch 64 is in the circuit containing conductor 60 so that the operation of motor 34 can be controlled depending upon the temperature of the air leaving space 22 through slots 24. A baffle 66 within housing 40 (FIG. 3) shields the limit switch and allows air to pass smoothly through housing 40 toward opening 56.

In operation, unit 10 is hand carried to wall panel 14 and tilted so that front wall 48 faces downwardly. Then projections 58 are inserted into a slot, such as a slot near the upper part of front panel 14 as shown in FIG. 1. The unit is arranged so that blower 26 is at the side of the panel so that ambient air to one side of the panel will enter inlet 30 of blower 26.

When electrical power is supplied to motor 34, it is energized so that air will flow into blower housing 28, then into and through housing 40 and outwardly thereof through outlet opening 56. The air will be forced into wall heater space 22 (FIG. 1*a*) and will cause heated air in this space to flow outwardly through the various slots 24. Thus, an increase in the volume rate of flow of hot air from space 22 is assured to thereby more efficiently and more readily keep the room adjacent to front panel 14.

During operation, limit switch 64 thermostatically senses the temperature of the air leaving space 22 through slots 24. The switch is normally open and does not close until the air temperature leaving slots 24 is, for instance, 80° F. When the switch closes, motor 34 is energized, causing heated air to be forced out of space 22 through slots 24. When this occurs, the heated air will increase the temperature in the vicinity of limit switch 64 at least for a short period of time and until the air in space starts to cool. Finally, the air temperature will drop in the vicinity of switch 64 such as to a temperature of 80° F. then switch 64 will open and blower motor 34 will be deenergized until the heated air builds up once again in space 22.

Blower unit 10 provides a means whereby significant fuel savings can be achieved. This is due to the fact that the air which normally rises in space 22 and passes out of slots 24 very slowly is caused to be forced out of space 22 at a greater rate so that the room adjacent the panel 14 will be more uniformly and more quickly heated. Also, unit 10 is of a size, weight and shape so that any person with substantially no skills can immediately mount the unit on front panel 14 and have the unit in operation immediately thereafter. The unit is small enough to be readily stored when it is not needed and is simple and rugged in construction and only the blower has moving parts. Thus, maintenance is minimized and unit 10 has a relatively long operating life.

What is claimed is:

1. A blower unit for use with a wall heater having a slotted upright panel covering one boundary of a wall heater space comprising: a blower having an air inlet, an air outlet, and means for generating a flow of air between the inlet and outlet; and means carried by the blower near the outlet thereof and insertable into a slot of the panel for mounting the blower on said panel externally thereof in a position with the outlet adjacent to and facing the panel and communicating with at least one of the slots to thereby permit air flowing out of the outlet to enter said one of the slots of the panel and be directed into the wall heater space to cause air to be forced out of the space through the remaining slots.

2. A blower unit as set forth in claim 1, wherein said mounting means includes a hollow housing secured to the blower adjacent to the outlet thereof, said housing having an air outlet opening positionable adjacent to the panel, and hook means carried by the housing and removably insertable in a slot of the panel for releasably coupling the same to the panel.

3. A blower unit as set forth in claim 2, wherein said coupling means includes a pair of spaced projections insertable into a slot of the panel in hooked relationship thereto.

4. A blower unit as set forth in claim 3, wherein each projection is L-shaped.

5. A blower unit as set forth in claim 2, wherein the length of the air outlet opening of the housing is sufficient to span the distance between a number of adjacent slots of the panel.

6. A blower unit for a wall heater of the type having a front, upright panel provided with a number of vertically spaced, generally horizontal slots comprising: a blower having an air inlet, an air outlet, and means for generating an air flow between the inlet and outlet; a hollow housing having wall means coupled with the blower for receiving air flow therefrom, said wall means having an air inlet opening aligned and communicating with the outlet of the blower and an air outlet opening spaced from the air inlet opening; and hook means carried by the housing and insertable in a slot of the panel for coupling the housing to said front panel externally thereof with the air outlet opening of the housing adjacent to, facing and aligned with at least one of the slots so that air generated in the blower will be forced through the housing and into the wall heater therethrough said one slot to cause heated air therein to be forced outwardly of the wall heater through the remaining slots of the front panel.

7. A blower unit as set forth in claim 6, wherein said wall means includes a generally flat front wall having the air outlet opening therein, said mounting means including a pair of spaced projections extending laterally from the front wall and removably insertable into a slot of the panel in hooked relationship thereto.

8. A blower unit as set forth in claim 5, wherein each projection is substantially L-shaped, the height of the second opening being sufficient to span at least a number of the slots in the panel.

9. A blower unit as set forth in claim 6, wherein is included means coupled with the air flow generating means of the blower for thermostatically controlling the operation of the same.

10. A blower unit as set forth in claim 5, wherein the controlling means comprises a thermostatically controlled limit switch carried by said wall means.

11. In a wall heater of the type having a front panel provided with a plurality of generally horizontal slots therethrough, the combination with the panel of a blower unit for directing air into the wall heater through at least one slot thereof, said blower unit comprising a blower provided with an inlet, and outlet, and means for generating an air flow between the inlet and outlet, a hollow housing having wall means coupled with the blower, said housing having a first opening aligned and communicating with the outlet of the blower and a second opening spaced from the first opening, and means carried by the wall means of the housing and insertable in a slot of the panel for mounting the housing on the panel with the second opening contiguous to the panel and in alignment with and facing said one slot.

* * * * *